US007749116B2

(12) United States Patent
Tang et al.

(10) Patent No.: US 7,749,116 B2
(45) Date of Patent: Jul. 6, 2010

(54) PANEL OF A BALL FOR A BALL GAME, A BALL, AND METHODS OF MAKING THE SAME

(75) Inventors: Ya Fang Tang, Hong Kong (CN); Yuen Yuen Chang, Ontario (CA)

(73) Assignee: Frank Chang, Hong Kong (HK)

( * ) Notice: Subject to any disclaimer, the term of this patent is extended or adjusted under 35 U.S.C. 154(b) by 0 days.

(21) Appl. No.: 11/017,718

(22) Filed: Dec. 22, 2004

(65) Prior Publication Data

US 2006/0046880 A1 Mar. 2, 2006

(30) Foreign Application Priority Data

Aug. 25, 2004 (CN) ..... 2004 1 0068524

(51) Int. Cl.
*A63B 41/10* (2006.01)

(52) U.S. Cl. ..... 473/604; 473/603; 473/598

(58) Field of Classification Search ..... 473/596–599, 473/603–605, 607–609; 273/157 R
See application file for complete search history.

(56) References Cited

U.S. PATENT DOCUMENTS

| | | | | | |
|---|---|---|---|---|---|
| 790,041 | A | * | 5/1905 | Englerth et al. | 473/598 |
| 1,187,029 | A | | 6/1916 | Beebout | |
| 1,502,784 | A | * | 7/1924 | Kennedy | 473/598 |
| 1,861,157 | A | * | 5/1932 | Grady | 473/598 |
| 1,923,236 | A | | 8/1933 | Sonnett et al. | |
| 1,980,472 | A | * | 11/1934 | Clarke | 473/598 |
| 2,080,894 | A | * | 5/1937 | Levinson | 473/603 |
| 2,240,256 | A | * | 4/1941 | Elmendorf | 428/98 |
| 3,119,618 | A | | 1/1964 | Molitor et al. | |
| 3,940,142 | A | * | 2/1976 | Hinz et al. | 273/146 |
| 4,333,648 | A | | 6/1982 | Aoyama | |
| 4,462,590 | A | * | 7/1984 | Mitchell | 473/603 |
| 4,660,831 | A | | 4/1987 | Kralik | |
| 4,856,781 | A | | 8/1989 | Shishido et al. | |
| 4,874,341 | A | * | 10/1989 | Ziegler | 446/109 |
| 5,580,049 | A | * | 12/1996 | Brantley | 473/599 |
| 5,683,317 | A | * | 11/1997 | Walker et al. | 473/600 |
| 5,752,890 | A | | 5/1998 | Shishido et al. | |
| 5,759,123 | A | | 6/1998 | Ou | |
| 5,772,545 | A | | 6/1998 | Ou | |
| 5,860,650 | A | * | 1/1999 | Scobbie et al. | 273/157 R |
| 6,022,283 | A | | 2/2000 | Schindler et al. | |

(Continued)

FOREIGN PATENT DOCUMENTS

| | | |
|---|---|---|
| JP | 27-3908 | 5/1927 |

(Continued)

*Primary Examiner*—Steven Wong
(74) *Attorney, Agent, or Firm*—Studebaker & Brackett PC; Donald R. Studebaker

(57) ABSTRACT

The present invention provides a panel of the ball for ball game, said panel has the folding portion and the opposite folding portion on its periphery, which are opposite to each other and made of the same continuous material. The folding portion and the opposite folding portion of said leather panels have the good engaging property and difficult to separate with each other during usage because they are made of the same material. The panel has simple manufacturing process and low production cost, making the ball for ball game comprising above panels have good using properties, simple manufacturing process and low production cost.

14 Claims, 10 Drawing Sheets

U.S. PATENT DOCUMENTS

| | | | | |
|---|---|---|---|---|
| 6,039,662 | A | 3/2000 | Chan | |
| 6,099,423 | A | 8/2000 | Ou | |
| 6,206,795 | B1 | 3/2001 | Ou | |
| 6,220,979 | B1 | 4/2001 | Chan | |
| 6,302,815 | B1 | 10/2001 | Shishido et al. | |
| 6,390,941 | B1 | 5/2002 | Ou | |
| 6,402,647 | B1 * | 6/2002 | Haseltine | 473/605 |
| 6,503,162 | B1 | 1/2003 | Shishido et al. | |
| 6,656,067 | B2 | 12/2003 | Ou | |
| 6,685,585 | B2 | 2/2004 | Shishido et al. | |
| 6,726,583 | B1 * | 4/2004 | Lai | 473/605 |
| 6,767,301 | B2 * | 7/2004 | Hu | 473/605 |
| 6,971,965 | B1 * | 12/2005 | Shishido | 473/604 |
| 2005/0136793 | A1 * | 6/2005 | Strunk | 446/487 |

FOREIGN PATENT DOCUMENTS

| | | |
|---|---|---|
| JP | 33-1619 | 2/1933 |
| JP | 38-16729 | 8/1938 |
| JP | 30-10612 | 7/1955 |
| JP | 61-127764 | 8/1986 |
| JP | 5-5157 | 1/1993 |
| JP | 63-34459 | 12/1994 |
| JP | 08252341 A | 10/1996 |
| JP | 09-019516 | 1/1997 |
| JP | 10-323409 | 12/1998 |
| WO | WO 9961114 | 12/1999 |

* cited by examiner

PANEL OF A BALL FOR A BALL GAME, A BALL, AND METHODS OF MAKING THE SAME

This application claims the priority of People's Republic of China Application No. 2004100685240, filed Aug. 25, 2004, the disclosure of which is expressly incorporated by reference herein.

TECHNICAL FIELD OF THE INVENTION

The present invention relates to a panel of a ball for a ball game such as a football, volleyball or handball game, a ball, as well as methods of making the panel and the ball.

BACKGROUND ART OF THE INVENTION

Generally, a ball for ball game is mainly composed of a bladder which can be inflated with air and can maintain certain air pressure; an reinforcing layer which realizes the quality of a ball such as sphericity and durability; and a skin layer, i.e. a panel, located on the reinforcing layer. The game ball can be categorized into the following three main types based on different manufacturing methods: laminated balls, hand-stitched balls, and machine-stitched balls.

FIG. 1 shows a ball having a hole 5 for admitting inflating air, and leather panels 4. FIGS. 2 to 4 show sectional views of balls of different types taken along line A-A. FIG. 2 illustrates a laminated ball. As described in U.S. Pat. No. 4,333,648, several-thousand meters of fiber like nylon filament are wound around an impermeable rubber bladder 2 along all peripheral directions to form reinforcing layer 3. In the process for winding nylon filament, an adhesive is coated on the nylon filament to prevent it from sliding off. The reinforcing layer itself has the functions of maintaining the spherical shape and resisting impact. Leather panels 4 are attached to the reinforcing layer 3 using adhesive 11 to form the skin layer. In order to improve the adherability, the reinforcing layer 3 can be covered with rubber. As shown in FIG. 1, the leather panels 4 of the ball generally has 32 pieces including 12 pieces of regular pentagon and 20 pieces of regular hexagon. The material for the panel is genuine leather or artificial leather (with a thickness of 1.0-2.0 mm). The peripheral portion of the back of the leather panel 4 is cut obliquely, and a V-shaped groove 6 is formed on a leather panel joint, so that the V-shaped panel groove 6 for suppressing air resistance and improving flying property is formed. As known from this manufacturing method, the laminated ball has an integral structure in which the bladder 2, reinforcing layer 3 and leather panels 4 are attached to each other using adhesive. The arrows represent the air pressure in the bladder 6. Laminated balls with the above structure have high quality, good sphericity and small errors in size and weight, because they can be produced in mechanized way. And the balls have excellent durability because the reinforcing layer is made of nylon filament.

However, laminated balls have some disadvantages. The panel grooves 6 is too wide and too shallow, being approximately 8 mm in width and 1 mm in depth, so that air resistance is not sufficiently low. The disadvantages also include poor gripping property, hard tactility when kicked, and poor controlling properties, so that the balls can not be official game balls.

FIG. 3 illustrates a hand-stitched ball. In a hand-stitched ball, an unattached bladder 2 is accommodated in a skin pocket made of complex panels 9, so that it is in a free state. After the air is inflated in, the bladder 2, made of elastic rubber, is pressed against the inner surface of the complex panels 9 due to the inner air pressure (as indicated by arrows in FIG. 3). A leather panel 4 with a liner or buffering material attached to its back is generally referred to as a complex panel. The hand-stitched ball is generally formed in such a process that the liner material as the reinforcing layer 3 made of laminated 3-4 pieces of fabrics with adhesive is attached to the back of the leather panel 4 to form the complex panel 9, the complex panels 9 are stitched together using a hand-stitching thread 7 (about 10000-denier thread) to form the ball shell having spherical shape, and the bladder 2, the same as the one used in the above-mentioned laminated ball, is accommodated in the ball shell. The place where the complex panels 9 are stitched is shown in FIG. 3, and the bladder 2 has the same shape as that of the inner surface of the panels 9 after the ball is inflated. The leather panels 4 are made of the same genuine or artificial leather as used in the laminated balls (with a thickness of 1.0-2.0 mm). The ball with this kind of structure is described in Japanese unexamined Patent Publication No. 19516/1997.

The hand-stitched ball has the following advantages. The ball's air resistance is small, and its flying and gripping properties are excellent because the panel groove 6 is narrow and deep, being approximately 2.5 mm and 2 mm respectively. Tactility is soft, and controllability is good because the reinforcing layer is made of fabrics. Hence, the hand-stitched balls are used in ball games in great quantities.

However, a hand-stitched ball can not be stitched using a sewing machine because of the three-dimensionality of the sphere and the thick and hard complex panels reinforced by the liner material. Therefore, the operators are required to have substantially the same familiarity and skills, otherwise the balls manufactured by different operators will have large differences. Moreover, there are the problems of low production efficiency, unstable quality and unacceptable differences in weight, size and sphericity because of the hand-stitching process.

FIG. 4 illustrates a machine-stitched ball. A machine-stitched ball, whose skin layers are stitched using machinery, has a structure that combines the structures of the laminated ball and the stitched ball. In particular, the bladder 2 and the reinforcing layer 3 have the same structures as the above-mentioned laminated ball, with a reinforcing layer 3 being used to maintain the spherical shape and ensure durability. The marginal edges of the leather panels 4 are folded inward, and the leather panels 4 with the marginal edges are stitched together with machine-threads 8 (about 500-denier) into a spherical shape to form the skin layer. Then the integrated bladder 2 and reinforcing layer 3 are accommodated in the skin layer. In this example, the leather panel 4 is made of the complex lamination leather comprising a TPU film (with a thickness of 0.10-0.50 mm) and an EVA foam (with the thickness of 1.0-5.0 mm), or made of artificial leather (with a thickness of 1.0-3.0 mm).

A machine-stitched ball with the above structure is described in U.S. Pat. No. 5,772,545. In a machine-stitched ball, being different from the hand-stitched ball, the liner material is not required on the back of the leather panels 4 because a reinforcing layer 3 exists on the bladder 2, so that the leather panels 4 are so soft that they can be stitched using a sewing machine.

The machine-stitched ball can be produced in a mechanized way according to the above-mentioned structure and manufacturing method, so that machine-stitched balls have good quality, small errors in size and weight, and excellent durability.

However, machine-stitched balls have the following disadvantages. FIG. 4 shows a stitched portion of the leather panels 4. The stitched portion is lifted up by the reinforcing layer 3 attached to the bladder 2, so that the leather panels 4 at this place become flat, thus, the sphericity of the ball is impaired. Therefore, the ball has irregular bounce and poor flying properties, it can not be used as an official ball for a ball game.

In order to solve the above-mentioned problems of the prior art, international patent publication No. W099/61114 discloses a solution (see FIGS. 5 and 6). This invention relates to the laminated ball shown in FIG. 2, and has the same reinforcing layer 3 and bladder 2 as the laminated ball, characterized in that a complex panel 9 with the following structure is used as the leather panel.

As described in the description of the invention, a peripheral edge portion of the leather panel 4 with a thickness of 1.6-1.8 mm is folded in at a 90° (or 180°) angle, and the height difference due to this fold is eliminated by attaching a thickness adjusting member 10 with the thickness substantially equal to the height difference on the lower portion of the step (see FIG. 5).

The manufacturing method of the invention is described in detail in the description of this patent. That is, the leather panel 4 with the specified size (see FIG. 6(*a*)) and a thickness adjusting member 10 smaller than the leather panel 4 (see FIG. 6(*b*)) are cut, adhesive 11 (natural latex or adhesives of CR or PU series) is applied on the back side of the leather panel 4 and the lower surface of the thickness adjusting member 10, and both the panel 4 and member 10 are laminated together, as shown in FIG. 6(*c*). In this example, the adhesive is applied on the lateral side 15 of the thickness adjusting member 10 also. According to the above steps, a folding portion 12, which can cover the lateral side 15 of the thickness adjusting member 10, is formed along the entire periphery of the leather panel 4.

After the lamination is pressed into a mould 13, the folding portion 12 is folded further to cover the lateral side 15 of the thickness adjusting member 10 and then attached to it (see FIG. 6(*d*)).

Using the above-mentioned method, a complex panel 9 with a thickness of 2-10 mm can be obtained.

However, the invention on the basis of the thickness adjusting member 10 attached to the leather panel 4 has the following problems.

First, compared with other products, this ball is used under harsher conditions. That is, the football or volleyball is frequently and repeatedly subjected to impact over 100 kgf when kicked or spiked. All parts of the ball may stay in a damp state for a long time because of rain or sweat. When played outdoors, the ball is often used in sand or mud. Especially in the summer the ball often encounters a high temperature over 40° C. whether in use or in storage. All these conditions significantly affect the attached portions of the ball. Frequently the leather panels peel off. In order to solve the above problem, the development of an excellent attaching technique is a great challenge in the art.

The peeling off problem also exists in the above example. This peeling off phenomenon results from following two causes. First, the adhesive force between the thickness adjusting member 10 and the leather panel 4 can not always be kept constant, because the air remains in some places when they are laminated, resulting in unattached areas. Moreover, it is likely that the adhesive is excessively dried or is beyond the effective hours.

Second, the adhesive force between the folding portion 12 and the lateral side 15 of the thickness adjusting member 10 is weak. As is well known, a strong adhesive force results from the correct adhesive, proper temperature and strong engaging pressure. In the above invention, as shown in FIG. 6(*d*), the folding portion 12 folded in a 90° angle is just in contact with the lateral side 15 of the thickness adjusting member 10, so that there is no pressure toward the lateral side. This problem becomes especially obvious when the thickness adjusting member 10 is made from a buffering material like sponge. When detachment problem occurs at the folding portion 12, the folding portion 12 is separated from the lateral side 15 of the thickness adjusting member 10, which becomes the beginning of separation and the separation will be developed all over the leather panels 4.

Third, in the above invention, the adhesive must be coated on both the thickness adjusting member 10 and the leather panel 4, especially in the thickness adjusting member 10, the adhesive must be coated on the lateral side 15 one by one. This is inefficient and time-consuming, resulting in high manufacturing cost.

The present invention is directed to solve these problems. The present invention can reduce the adhered portions and significantly increase the strength of the adhered portions, while reducing the risk of detachment, so that the above-mentioned problems are solved. The manufacturing process of the ball panel is significantly simplified and the manufacturing cost is reduced.

SUMMARY OF THE INVENTION

One object of the invention is to provide a panel of the ball for a ball game, simplify manufacturing process, lower production cost, and produce desired properties.

Another object of the invention is to provide a ball that comprises the above panels.

A panel of the ball of the present invention has a folding portion and an opposite folding portion along its periphery, which are opposite each other and made from the same continuous material.

In the panel of the ball of the present invention, the folding portion and the opposite folding potion are engaged with each other through an engaging layer.

In the panel of the ball of the present invention, the engaging layer is composed of a melted layer of the panel member.

In the panel of the ball of the present invention, the engaging layer is composed of an adhesive.

In the panel of the ball of the present invention, the panel is composed in a laminated structure including a skin layer and a fold engaging material.

In the panel of the ball of the present invention, slight ruggedness is provided on the periphery surface of the panel.

In the panel of the ball of the present invention, adhesive is coated in a teeth-shaped pattern on the side surface of the panel.

A ball of the invention from the inside to the outside in sequence comprises a bladder, a reinforcing layer and the panels of the ball.

In the ball of the present invention, the panels are adhered on the reinforcing layer directly or through a covered rubber layer.

In another ball of the present invention, the folding portion of the panel is folded inwardly and then stitched to each other.

In a ball of the present invention, the joint of the adjacent panels can be connected with adhesive.

In the panel with said structure, the folding portion and the opposite folding portion are made of the same material, so that they have good engaging property and are difficult to separate during usage. In the manufacturing process, it is unnecessary to coat adhesive one by one if the engaging layer is composed of the melted layer, so that the manufacturing process is simplified and production cost is reduced.

Therefore, a ball comprising the above-mentioned panels has good properties, simplified manufacturing process and low production costs.

Furthermore, in a ball comprising the above-mentioned panels, the folding portion is folded inwardly and then stitched together, so that the sewing machine can be used to stitch the panels, improving production efficiency. The stitched portion can not be lifted up as occurring in the prior art, so that the sphericity of the ball can be maintained, and the quality of the ball can be increased.

DETAILED DESCRIPTION OF THE INVENTION

Figure 7:
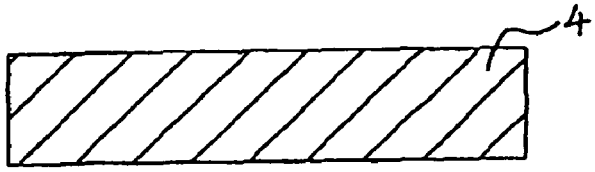
FIG. 7(*a*)-7(*l*) show the structure of a leather panel of the present invention and its manufacturing process.
Figure 7:
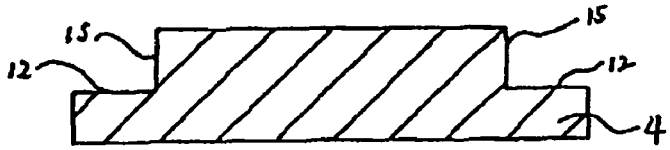
Figure 7:
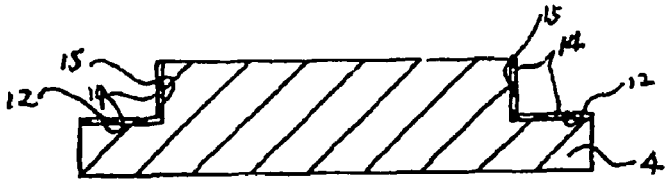
Figure 7:
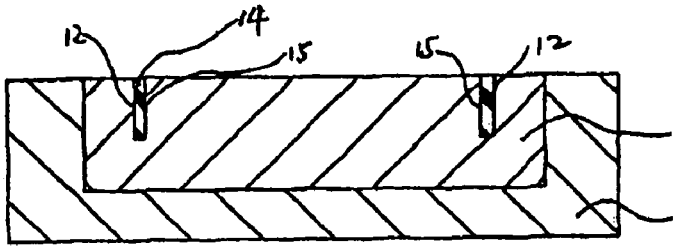
Figure 7:
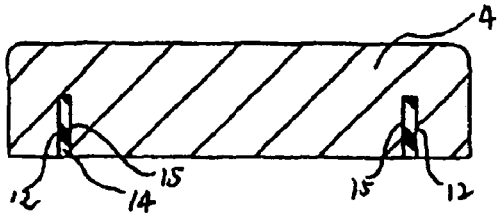
Figure 7:
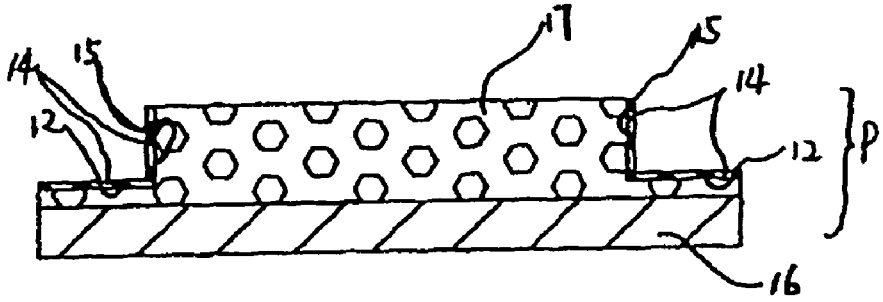
Figure 7:
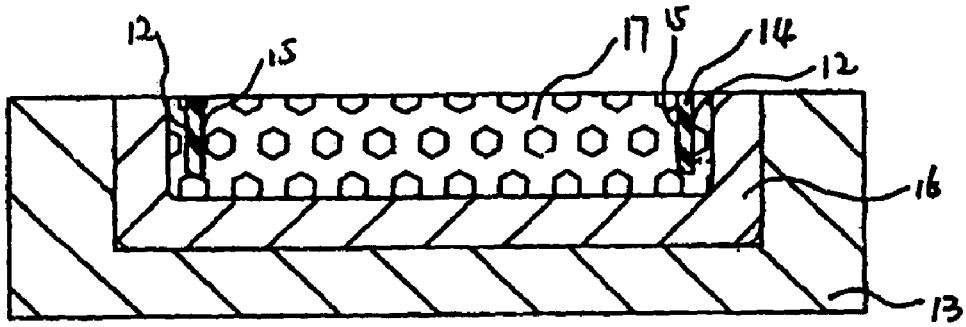
Figure 7:
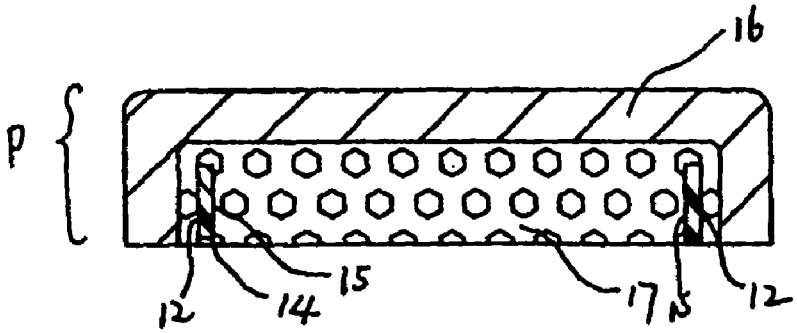
Figure 7:
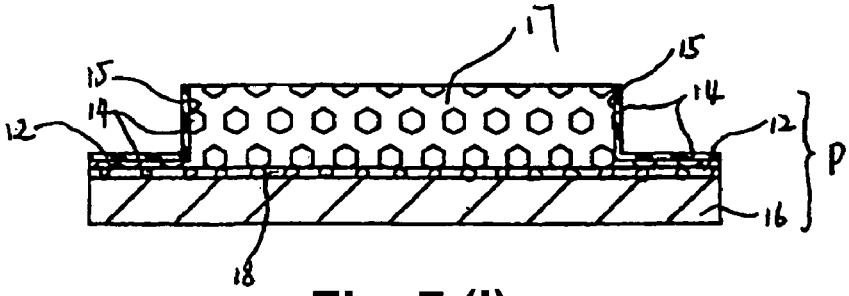
Figure 7:
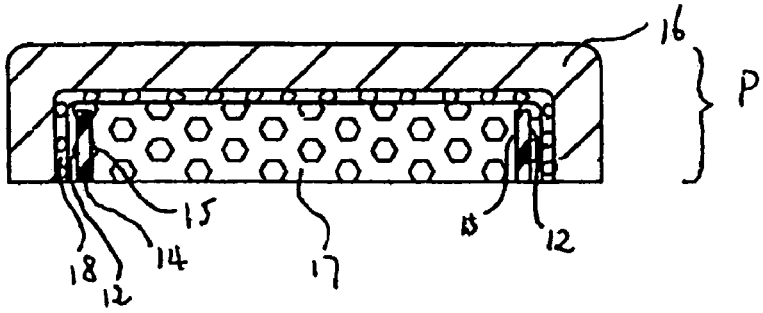
Figure 7:
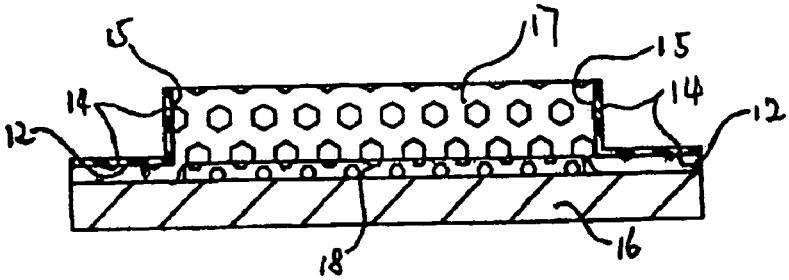
Figure 7:
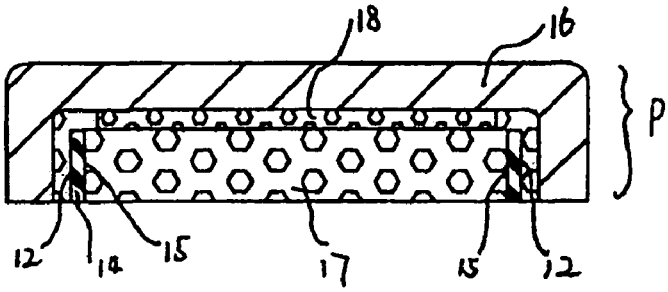

FIG. 7 shows the manufacturing process of a leather panel of the present invention.

As shown in FIG. 7(*a*), a skin material is cut to form a leather panel 4 with the specified size. The leather panels of, for example, a football can consist of 32 pieces including 20 pieces of regular hexagon and 12 pieces of regular pentagon. It is possible to have other combinations, such as the combination of 12 pieces of regular pentagon or 20 pieces of regular triangular with 12 pieces of regular pentagon. That is, any shapes are possible so long as they can cover the entire sphere. The cross section of the leather panel 4 is a rectangle.

The leather panels 4 is made of artificial leather with a thickness of 2 to 8 mm, preferably 3 to 5 mm. The main material of artificial leather is polyurethane (PU) or polyvinyl chloride (PVC). Another kind of leather panel is made of a complex leather material comprising a thermal plastic polyurethane (TPU) film and a foam material such as ethylene-vinyl acetate copolymer (EVA), polyethylene (PE), ethylene-propylene-diene ternary copolymer rubber (EPDM) and styrene-butadiene (SBR). Those materials have sufficient durability and flexibility required of a ball. And the above materials are easy to buy in the market.

Next, as shown in FIG. 7(*b*), the periphery of the leather panel 4 as shown in FIG. 7(*a*) is processed to make the skin material have a T-shaped section. A folding portion 12 will then be formed.

To the form folding portion 12, the periphery of the leather panel 4 can be processed using any of the following processing methods:

The first method is the high-frequency processing method. The periphery of the leather panel 4 is pressed using an embossing die which has the same shape as the folding portion 12 with a voltage of several thousand volts and a high-frequency of tens thousand Hz. As shown in FIG. 7(*b*), the periphery is compressed under the effect of the heat generated by the voltage and the high-frequency, and the folding portion 12 can be formed instantaneously, with the opposite folding portion 15 being formed simultaneously.

The second method is the hot plate processing method. The periphery of the leather panel 4 is pressed using an embossing die which has the same shape as the folding portion 12 with the die temperature at 100-400° C. As shown in FIG. 7(*b*), the periphery is pressed and melted to form the folding portion 12, the opposite folding portion 15 being formed simultaneously. Being similar to the above processing method, the hot plate processing method completes its operation instantaneously. In this method, the selected range of temperature depends on embossing pressure, pressing duration and the panel material.

Figure 6:
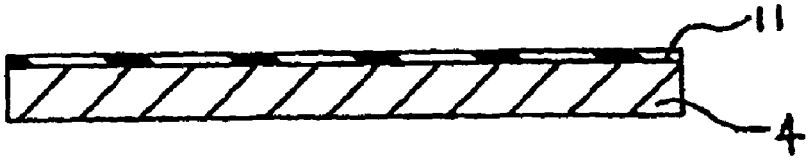
FIG. 6(*a*)-6(*d*) show the manufacturing process of a leather panel of the ball of FIG. 5.
Figure 6:
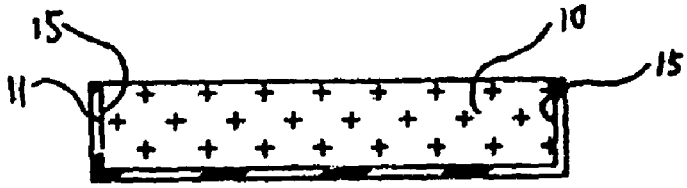
Figure 6:
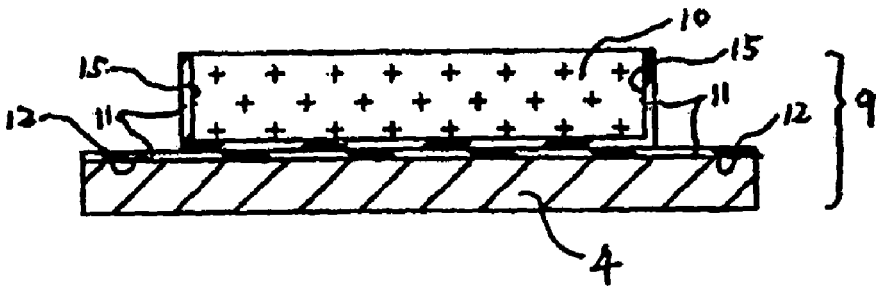
Figure 6:
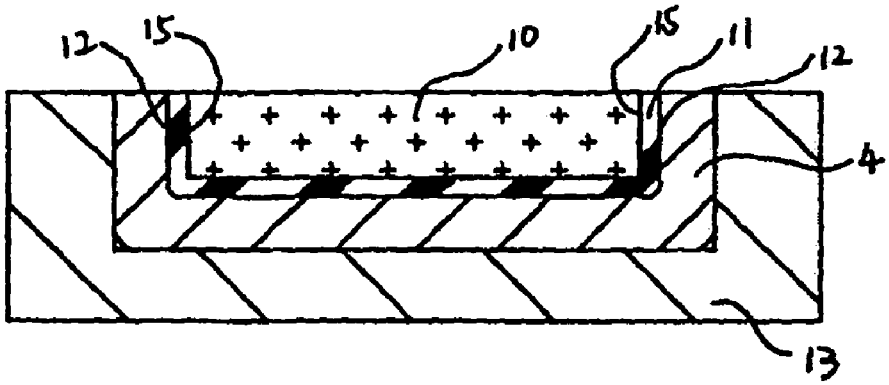

As shown in FIG. 7(*b*), the folding potion 12 and the opposite folding portion 15 processed using the above processing methods are integrated as a whole. They are made of the same continuous material, rather than two materials attached with adhesive as is in the prior art (as shown in FIG. 6).

FIG. 7(*c*) shows the forming state of an engaging layer 14 for engaging the folding portion 12 with the opposite folding portion 15. The engaging layer 14 is formed using the following method. That is, in the high-frequency processing method and the hot plate processing method, a portion of the leather panel 4, which is contacted by the embossing die, is melt by heat in the range of 0.1-1.0 mm in its direction. This portion will be the engaging layer 14 for engaging. This state will last 3-4 seconds after the embossing die is separated from the leather panel 4, the following process being performed to obtain strong engagement during this 3-4 seconds.

As shown in FIG. 7(*d*), the leather panel 4 is pressed into a mould 13 having a recess which has substantially the same shape as the final leather panel when the engaging layer 14 staying in the melting state, the folding portion 12 and the opposite folding portion 15 being engaged with each other through the engaging layer 14 in this process. When the engaging layer 14 is cooled down, the folding portion 12 and the opposite portion 15 are firmly attached together, finally forming the leather panel 4 as shown in FIG. 7(*e*). In the case of the high-frequency processing method and the hot plate processing method, the leather panel 4 must be pressed into the mould 13 within 3-5 seconds after the engaging layer 14 is formed, because, as described above, the engaging layer 14 should be in the melting state when these two portions are engaged. These processing operations can be performed easily by air cylinders for pressing and moving which are arranged along a moving path and a programming device.

According to the above high-frequency processing method and the hot plate processing method, the folding portion 12 is formed while the engaging layer 14 is formed simultaneously, so that the complicated process for coating adhesive on the engaging faces of all sides can be omitted, and the manufacturing cost can be substantially reduced.

As described above, in this invention the pressing force applied from the folding portion 12 to the opposite folding portion 15 is still very small. However, the folding portion 12 and the opposite folding portion 15 are made of the same material, and the material molecules of both portions are mixed with each other after they are engaged in the melting state and cooled down. In this engagement, a large pressing force is unnecessary, because a smaller pressing force is enough to obtain very firm engagement. In a stretching test for an engaging portion, it was confirmed that the material of these portions is broken without separation of engagement.

For the materials unsuitable for the high-frequency processing method and the hot plate processing method, the following methods can be used.

Using a cutting method, a folding portion 12 is obtained by placing a leather panel 4 on a rotating table to be rotated and cutting the periphery of the leather panel 4 with a sharp cutting-tool in horizontal and vertical directions at the same time, while the opposite folding portion 15 is obtained simultaneously. The cutting-tool used in the invention can be rotating circular cutting-tool or very small triangular cutting-tool. In this method, the folding portion 12 must be processed one by one, the processing efficiency is lower than the above two methods, but this method is very effective for materials such as vulcanized rubbers and the like, which are unsuitable for the above two methods.

Besides the above-mentioned three processing methods, the following methods can be used also to process the periphery of the leather panel 4. One of these is the cold-pressing method. Compressed air (1~9 kg/cm$^2$) is generally used in the high-frequency processing method and the hot plate processing method. However, the folding portion and the opposite folding portion are obtained by compressing the periphery of the leather panel with a high pressure (10 kg/cm$^2$~100 kg/cm$^2$) from the hydraulic press.

The laser processing method is another method. In this method, laser is used to generate heat to cut and melt the periphery of the leather panel.

However, these methods must use large and expensive apparatuses. Therefore, the first three methods are the main methods.

For the leather panel 4 processed using the cutting method, adhesive as the engaging layer 14 is coated on the folding portion 12 and the opposite folding portion 15 one by one. Then the leather panel 4 is pressed into the mould 13 in the same manner as in the above embodiments to obtain a leather panel having the desired final shape, detailed steps being omitted.

The cutting method has the same attaching process as the laminated ball discussed above. In the discussed example, however, different materials are attached with adhesive, while in the cutting method, the same material is stuck with the adhesive as an engaging layer 14, so that the adhesive force between the folding portion 12 and the opposite folding portion 15 will be stronger, being similar to that in the high-frequency processing method and the hot plate processing method.

In the method for applying adhesive on the folding portion 12 and the opposite folding portion 15 one by one, the manufacturing cost is increased, but this method is the only effective one with a relatively low cost for the materials unsuitable for the high-frequency processing method and the hot plate processing method.

In addition, FIG. 7(*h*), (*j*), (*l*) show other structures of the leather panel 4.

The leather panels of the balls are made from different materials according to the types of the balls, the requirements of the user, the conditions under which the balls are used and cost considerations. Some of these materials for the leather panel can not be used to obtain the engaging layer in the melting state using the high-frequency processing method and the hot plate processing method. Moreover, it is difficult to cut a material having a high adhering property if the cutting method is used. In this case, the above-mentioned problems can be solved by laminating some other materials to form an engaging layer.

FIG. 7(*f*) to FIG. 7(*h*) shows complex leather panels P obtained by attaching a fold engaging material 17 and a top skin material 16 with an adhesive such as natural latex, polyurethane, or the like.

In this example, the top skin material 16 (with a thickness of 1.0~2.0 mm) as the top layer is artificial leather (as described above) with the liner made of cotton/polyester blend fabric or a foam rubber material. An EVA foam layer with a thickness of 1.0~5.0 mm is used as a fold engaging material 17. It is well known that cotton/polyester blend fabric and foam rubber can not be melted if the high-frequency processing method or the hot plate processing method is used. However, these two materials can be attached to an EVA foam material firmly with adhesive. On the other hand, the engaging layer 14 in melting state can be easily obtained from the EVA foam material using the high-frequency processing method or the hot plate processing method.

FIG. 7(*f*) shows an example of the above complex leather panel P. In this example, the folding portion 12 and the opposite folding portion 15 are obtained, while the engaging layer 14 is obtained simultaneously on the fold engaging material 17 using the high-frequency processing method or the hot plate processing method. As shown in FIG. 7(*g*), the complex leather panel P is pressed into the same mould 13 as that in FIG. 7(*d*) when the engaging layer 14 stays in the melting state, and a complex leather panel P as shown in FIG. 7(*h*) similar to the above example, whose periphery is folded, can be obtained after pressing and cooling.

To sum up the above, in a complex leather panel P as shown in FIG. 7(*h*), a main engaging portion exists between the folding portion 12 and the opposite folding portion 15. At this engaging portion the same continuous material is melted and engaged if the high-frequency processing method or the hot plate processing method is especially used, so that a very firm engagement can be obtained. Similarly, the adhered portions can be substantially reduced if the cutting method is used, and the strong adhesive force can be ensured because the folding portion 12 and the opposite folding portion 15 are made of the same material, and the adhering effect of the same material can be excellently realized.

According to various usage requirements, the leather panel 4 can have various structures described below.

FIGS. 7(*i*) and (*j*) show another complex leather panel P to which a function assigning material 18 (which can assign a certain function to the panel) is attached. The function assigning material 18 is laminated between the top skin material 16 and the fold engaging material 17. According to the requirement of the user for high durability, a fabric of polyester and the like as a function assigning material 18 can be provided between the skin material 16 and the fold engaging material 17 to form a leather panel having excellent durability. Alternatively, an SBR foam material having excellent silencing effect and softness can be used as a function assigning material 18, making the ball have soft tactility and reduce the metallic impact sound when the ball is kicked.

In case that the function assigning material 18 is very hard and to bend because of its rigidity, as shown in FIGS. 7(*k*) and (*l*), the function assigning material 18 is cut into pieces smaller than the top skin material 16, and the fold engaging material 17 is overlaid on the function assigning material 18 to form the complex leather panels P as shown in FIG. 7(*l*).

Figure 1:
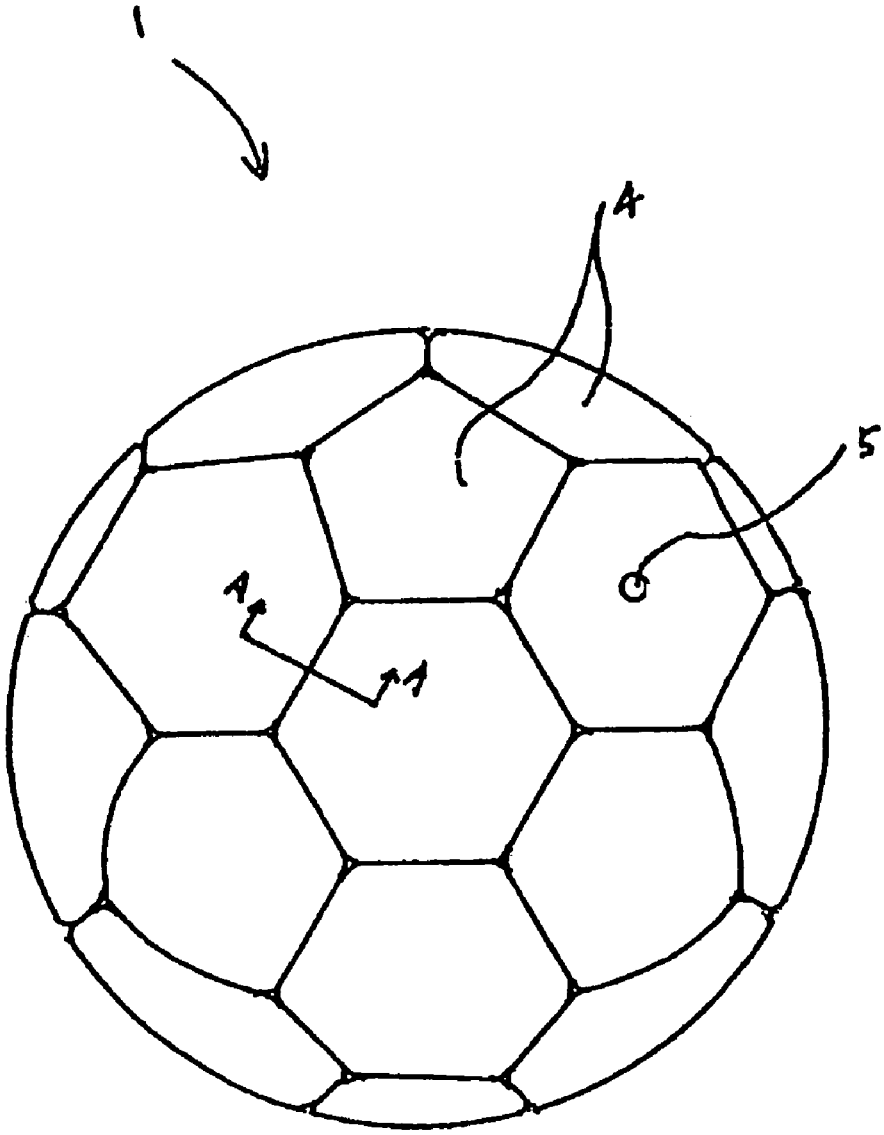
FIG. 1 shows a ball for a ball game.
Figure 2:
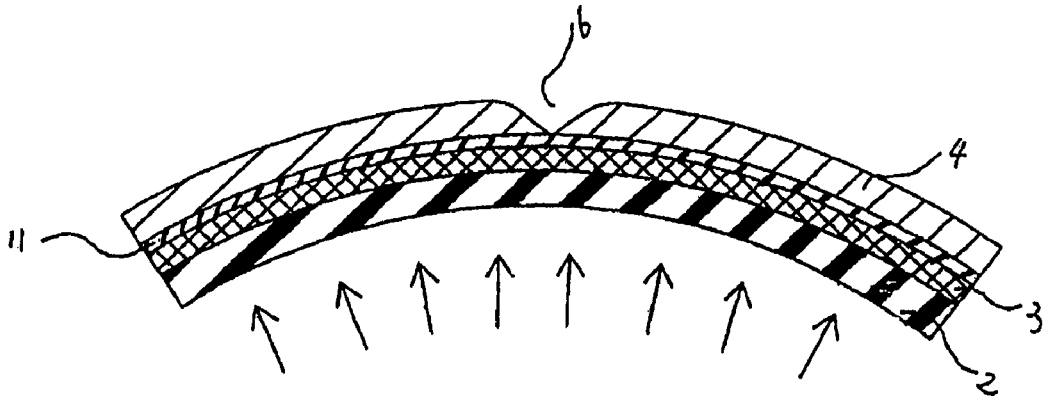
Fig. 2 PRIOR ART
FIG. 2 shows the structure of a laminated ball of the prior art, which is taken along A-A line in FIG. 1.
Figure 3:
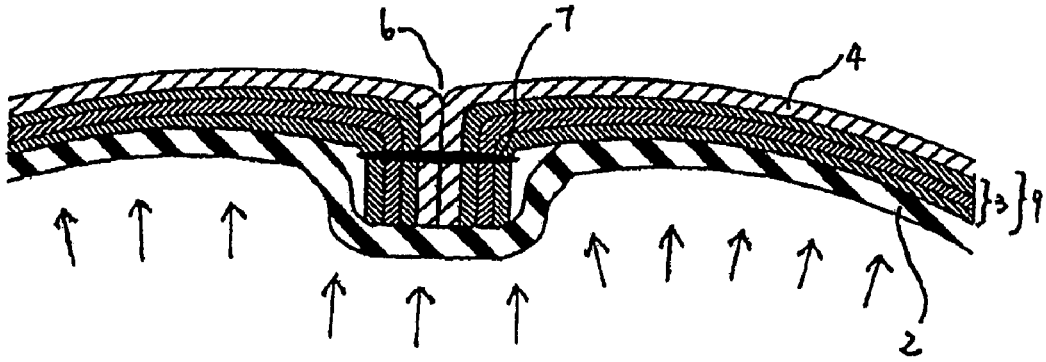
Fig. 3 PRIOR ART
FIG. 3 shows the structure of a hand-stitched ball of the prior art, which is taken along A-A line in FIG. 1.
Figure 4:
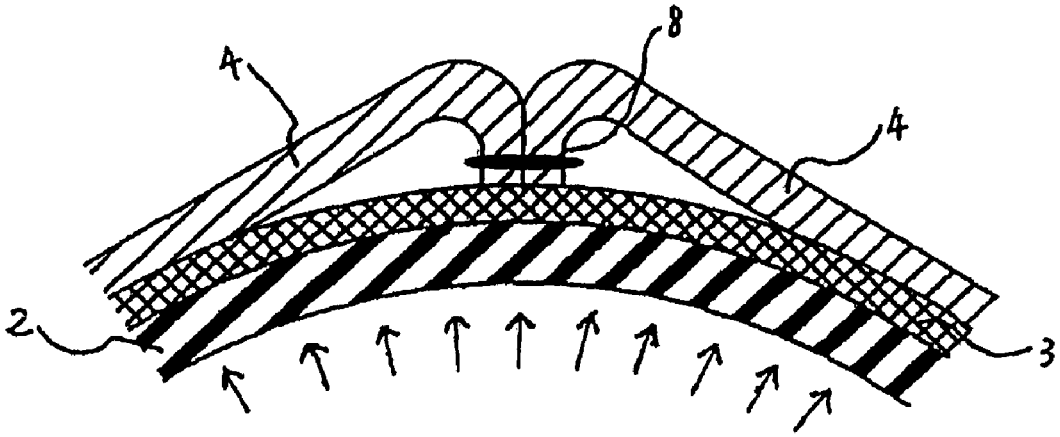
Fig. 4 PRIOR ART
FIG. 4 shows the structure of a machine-stitched ball of the prior art, which is taken along A-A line in FIG. 1.
Figure 5:
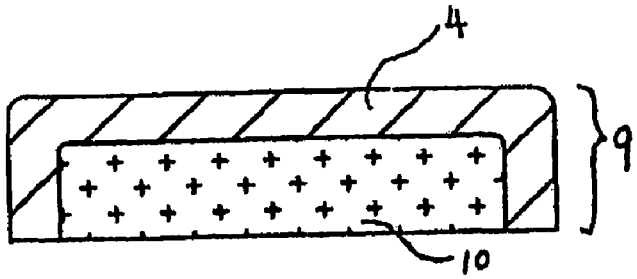
FIG. 5 shows the structure of a leather panel of a ball of the international patent publication No. W099/61114, which is taken along A-A line in FIG. 1.
Figure 8:
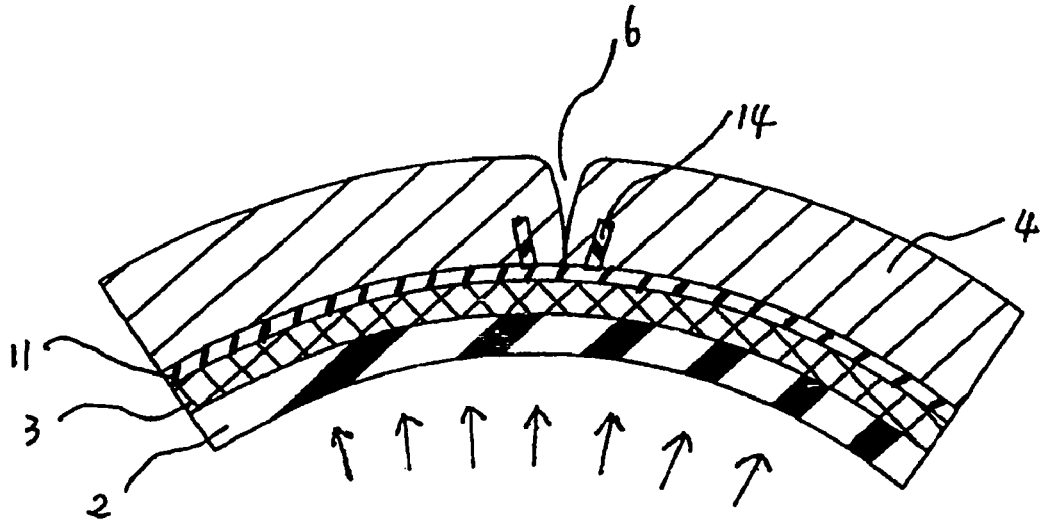
FIG. 8(*a*)-8(*b*) show a diagram of one method for laminating the leather panels of the present invention on a reinforcing layer, which is taken along A-A line in FIG. 1.
Figure 8:
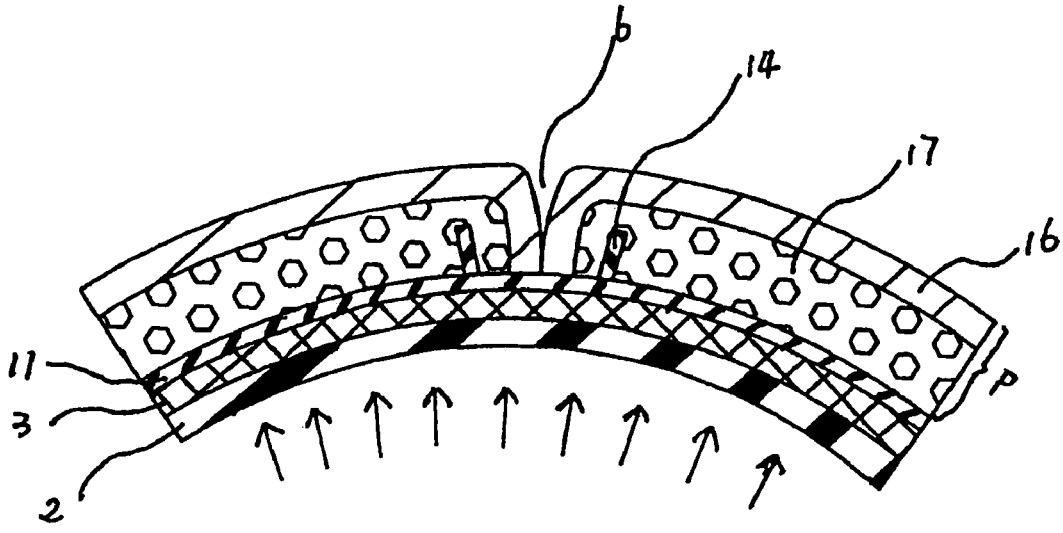
Figure 9:
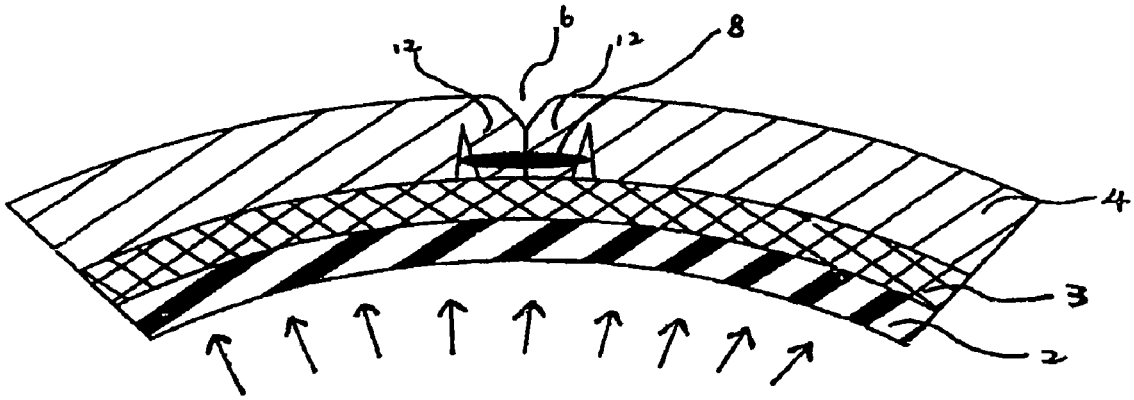
FIG. 9 shows a diagram of another method for covering the reinforcing layer with the leather panels of the present invention, which is taken along A-A line in FIG. 1.

FIGS. 8 and 9 show a diagram of a ball completed using leather panels 4, and complex leather panels P, according to the invention, which is taken along line A-A in FIG. 1.

FIGS. 8(*a*) and 8(*b*) show the examples of various leather panels suitable for the laminated ball. Leather panels 4 and complex leather panels P are attached to each other with adhesive 11 on a reinforcing layer 3 directly or through covered rubber. The reinforcing layer 3 can be formed by winding nylon filament around a bladder 2, sewing a ball-shaped pocket with fabric or adhesive fabric on the bladder. Chloroprene (CR) base adhesive, polyurethane, natural latex and the like can be used as adhesive.

It is confirmed that the panel grooves 6 having the same width and depth as the hand-stitched ball, being narrow and deep, can be obtained in the above-mentioned structure, so that air resistance can be reduced and the ball has the same flying properties as a hand-stitched ball.

In this embodiment, it is confirmed that a ball manufactured by adhesive leather panels 4 and complex leather panels P of the present invention on a ball-shaped reinforcing layer 3 made of fabric has the same properties in all aspects as a hand-stitched ball of the prior art. That is, the ball has soft tactility when kicked and excellent control property. Furthermore, the ball has the same flying and bounce properties as a hand-stitched ball. Being different from the hand-stitched ball, the leather panels 4 and complex leather panels P need not be stitched, so that durability is substantially improved. All these balls can be manufactured in mechanized way, so that mass-production with high quality and stable yield can be realized. The present invention has improved all aspects such as the quality, durability, properties and manufacturing cost, making a great contribution to the industry and the competition.

FIG. 9 shows an example of a machine-stitched ball. In this example, an engaging layer 14 as shown in FIG. 7(*c*) is not needed and the process for pressing the leather panel into the mould 14 is omitted. That is, a folding portion 12 of the leather panel 4 as shown in FIG. 7(*b*) is folded inwardly and stitched with stitching threads 8 into the ball-shaped skin layer, and then a reinforcing layer or carcass 3 and a bladder 2, which are integrated as a whole, are accommodated in the ball-shaped skin layer. According to this method, the folding portion 12 with a thickness that is half of the thickness of the leather panel 4 or lower is used as the stitching portion. As shown in FIG. 9, the stitching portion is not beyond the thickness of the leather panel 4, so that it will not be lifted by the reinforcing layer 3, as is in the prior art, and the shape of the ball will not be affected. In this embodiment, it is unnecessary to attach leather panels 4 on the reinforcing layer, so that the adhesive 11 as shown in FIG. 8 is not needed; the leather panel 4 stays in a free state, so that softer tactility can be obtained.

Furthermore, adhesive (not shown) is applied to the outer sides of the end faces of adjacent leather panels 4 or complex leather panels P to attach these side faces between the adjacent leather panels, so that water can be prevented from seeping into the ball. Therefore, the weight increase due to water seeping of the ball will not occur when used in rainy days, and the durability can be improved also.

A ball made from the leather panels of the present invention has air resistance similar to that of a hand-stitched ball.

Figure 10:
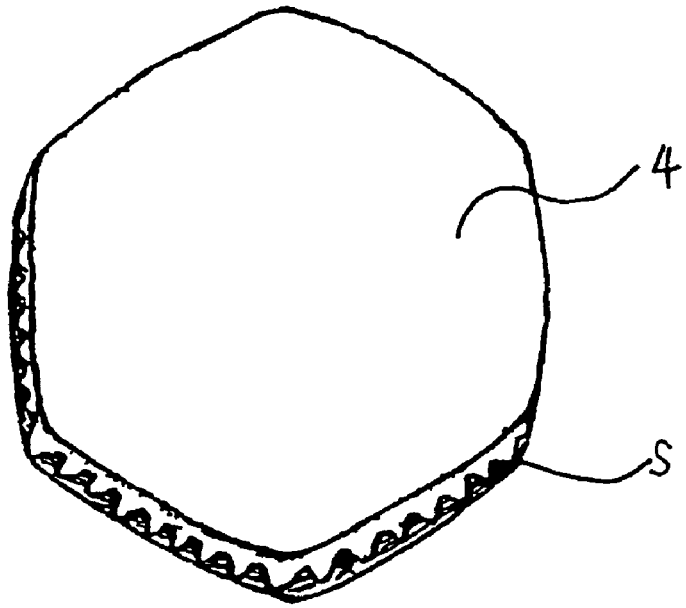
FIG. 10(*a*)-10(*b*) show a diagram of a side surface pattern of a leather panel of the present invention.
Figure 10:
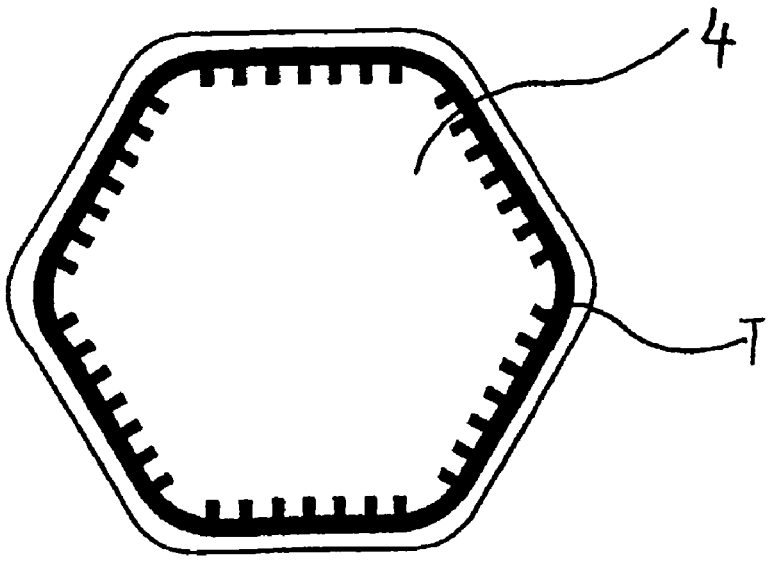

As a method for further reducing air resistance, slight roughness S shown in FIG. 10(*a*) similar to a stitching seam can be provided on the periphery surface of a leather panel 4 or complex leather panel P using high-frequency processing. Leather panels 4 can be processed to have the rough periphery using the embossing method, that is, slight roughness S is processed using the high-frequency processing method or the hot plate pressing method before the folding process. The roughness has the same intervals as the stitches of a hand-stitched ball, preferred at 4 to 5 mm, and the preferred height at 0.5 to 1.5 mm. The appearance of the leather panel after folding is shown in FIG. 10(*a*).

FIG. 10(*b*) shows another method for the same object. In this method, adhesive is applied to teeth-shaped pattern T on the periphery of a leather panel 4 or a complex leather panel P. The pattern can have the same interval and height as the above example. According to the pattern, the seam-shaped appearance can be realized by engaging the concaves and the convexes of the teeth, which are coated with adhesive, with each other between the side faces of the adjacent leather panels when these leather panels are attached to the ball. The effect is equivalent to the hand-stitched ball, that is, the air resistance is reduced and the grasping property is improved.

To summarize, the leather panel 4 and complex leather panels P of the present invention have the following properties and advantages:

(1) The folding portion and the opposite folding portion are made of the same continuous material, and the engaging force is strong and the durability is improved.

(2) The process for applying adhesive is omitted, and the manufacturing process is simple.

(3) All manufacturing processes can be performed in a mechanized manner, improving efficiency and quality.

A ball using the ball panels of the present invention has the following advantages:

(1) excellent durability, (2) the same properties as the hand-stitched ball, (3) high production efficiency, and (4) high quality.

Therefore, the provides low-price and high-quality ball for ball games.

What is claimed is:

1. A ball for a ball game, comprising:

a carcass; and a panel for covering the carcass, the panel comprising:

a main body portion having a top surface, a bottom surface and a peripheral edge surface extending about an entire periphery of said main body portion; and a folding portion extending from said peripheral edge surface of said main body portion; said main body portion and said folding portion being of the same continuous material with a thickness of said folding portion being less than a thickness of said main body portion and said folding portion being folded into engagement with said peripheral edge surface about the entire periphery of said main body portion.

2. The ball according to claim 1, wherein said folding portion is engaged with said main body portion through an engaging layer.

3. The ball according to claim 2, wherein said engaging layer is composed of a melted layer.

4. The ball according to claim 2, wherein said engaging layer is composed of adhesive.

5. The ball according to claim 4, further comprising a laminate structure of materials including a top skin material and a fold engaging material.

6. The ball according to claim 5, wherein slight roughness is provided on a periphery surface of said panel.

7. The ball according to claim 1, further comprising a laminate structure of materials including a top skin material and a fold engaging material.

8. The ball according to claim 1, wherein slight roughness is provided on a periphery surface of said panel.

9. The ball according to claim 1, wherein said main body portion includes a top skin material.

10. The ball according to claim 9, wherein said top skin extends over said folding portion.

11. The ball according to claim 1, wherein said main body portion and said folding portion are formed of a laminate structure of materials including at least a top skin material.

12. The ball according to claim 9, wherein said top skin includes a top layer and a liner.

13. The ball according to claim 12, wherein said top layer comprises at least one of a natural an artificial leather.

14. The ball according to claim 12, wherein said liner comprises at least one of a woven and non-woven material.

* * * * *